US011282309B2

(12) United States Patent
Kagaya et al.

(10) Patent No.: US 11,282,309 B2
(45) **Date of Patent: *Mar. 22, 2022**

(54) CONTROL METHOD, INFORMATION PROCESSING DEVICE, MANAGEMENT SYSTEM, AND RECORDING MEDIUM

(71) Applicant: Panasonic Intellectual Property Corporation of America, Torrance, CA (US)

(72) Inventors: Fumiaki Kagaya, Osaka (JP); Eiichi Abe, Miyagi (JP); Junichiro Soeda, Nara (JP)

(73) Assignee: PANASONIC INTELLECTUAL PROPERTY CORPORATION OF AMERICA, Torrance, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/065,066

(22) Filed: Oct. 7, 2020

(65) Prior Publication Data

US 2021/0019965 A1 Jan. 21, 2021

Related U.S. Application Data

(63) Continuation of application No. 16/287,334, filed on Feb. 27, 2019, now Pat. No. 10,839,625.

(Continued)

(30) Foreign Application Priority Data

Oct. 30, 2018 (JP) ..... JP2018-204076

(51) Int. Cl.
*G07C 9/00* (2020.01)
*G07F 17/12* (2006.01)

(52) U.S. Cl.
CPC ..... *G07C 9/00182* (2013.01); *G07C 9/00571* (2013.01); *G07F 17/12* (2013.01); *G07F 17/13* (2020.05); *G07C 9/00912* (2013.01)

(58) Field of Classification Search
CPC ..... G07C 9/00
See application file for complete search history.

(56) References Cited

U.S. PATENT DOCUMENTS 10,475,272 B2 11/2019 Campero
10,839,625 B2 * 11/2020 Kagaya ..... G07C 9/00571

(Continued)

FOREIGN PATENT DOCUMENTS

CN 106875518 6/2017
WO 02/07119 1/2002

OTHER PUBLICATIONS

Communication pursuant to Article 94(3) EPC dated Dec. 9, 2020 in corresponding European Patent Application No. 19158421.8.

(Continued)

*Primary Examiner* — K. Wong
(74) *Attorney, Agent, or Firm* — Wenderoth, Lind & Ponack, L.L.P.

(57) ABSTRACT

A control method of controlling, using a distributed ledger, locking or unlocking of one or more storage units, in each of which an item is storable, includes: operating a first smart contract and one or more second smart contracts by a code, stored in the distributed ledger, being executed by a computer, the first smart contract managing the one or more second smart contracts that are in one-to-one correspondence with the one or more storage units; controlling, by each of the one or more second smart contracts, locking or unlocking of a corresponding one of the one or more storage units, the controlling being performed under the management by the first smart contract; and controlling, by the first (Continued)

smart contract, whether to place each of the one or more second smart contracts under the management.

4 Claims, 14 Drawing Sheets

Related U.S. Application Data

(60) Provisional application No. 62/647,197, filed on Mar. 23, 2018.

(56) References Cited

U.S. PATENT DOCUMENTS

2019/0317677 A1 10/2019 Tanaka
2019/0333304 A1 10/2019 Flynn

OTHER PUBLICATIONS

Savelyev, "Contract Law 2.0: Smartcontracts as the Beginning of the End of Classic Contract Law", National Research University Higher School of Economics, Jan. 2016, XP055756621.
"GMO Internet Group, Saison Information Systems Co., Ltd., and Parco Co., Ltd. have jointly conducted the second field trial utilizing blockchain and IoT", GMO Internet Inc., [online] https://cloud.z.com/jp/news-ep/iot2/, Jun. 21, 2017, with partial English translation.
Extended European Search Report dated Sep. 9, 2019 in corresponding European Patent Application No. 19158421.8.
Anna Lali Tsilidou et al., "Further applications of the blockchain", XP055615207, May 14, 2015.

* cited by examiner

FIG. 5

102

| 41 STORAGE ID | 42 USED/UNUSED |
|---|---|
| 1001 | USED |
| 1002 | UNUSED |
| ... | ... |

FIG. 6

104

| ADDRESS OF SMART CONTRACT S2 |
|---|
| ADDRESS 1 |
| ADDRESS 2 |
| ... |
| ADDRESS n |

FIG. 7

116

| 44 FUNCTION ID | 45 STATE |
|---|---|
| 1001 | ON |
| 1002 | OFF |

FIG. 15

122

| 61 SYSTEM ID | 62 USED/UNUSED | 63 SYSTEM ID |
|---|---|---|
| 1001 | USED | 30A |
| 1002 | UNUSED | 30A |
| ••• | ••• | ••• |
| 2001 | USED | 30B |
| 2002 | UNUSED | 30B |
| ••• | ••• | ••• |

CONTROL METHOD, INFORMATION PROCESSING DEVICE, MANAGEMENT SYSTEM, AND RECORDING MEDIUM

CROSS REFERENCE TO RELATED APPLICATIONS

This application is a continuation of U.S. application Ser. No. 16/287,334, filed Feb. 27, 2019, which claims the benefit of priority of U.S. Provisional Patent Application No. 62/647,197 filed on Mar. 23, 2018 and Japanese Patent Application Number 2018-204076 filed on Oct. 30, 2018, the entire contents of which are hereby incorporated by reference.

BACKGROUND

1. Technical Field

The present disclosure relates to a control method, an information processing device, a management system, and a recording medium.

2. Description of the Related Art

A technique for managing, using a blockchain, locking or unlocking of a storage unit, such as a delivery locker that stores items has been disclosed (see GMO Internet Inc., *GMO Internet Group, Saison Information Systems Co., Ltd., and Parco Co., Ltd. have jointly conducted the second field trial utilizing blockchain and IoT* (*GMO Internet Group, Saison Joho Systems, Parco ga kyodo de blockchain to IoT wo katsuyo shita jissho jikken no dainidan wo jisshi*), Jun. 21, 2017, retrieved Oct. 25, 2018 from https://cloud.z.com/jp/news-ep/iot2/). The smart contracts using a blockchain can be used for the management of locking or unlocking of storage units. The storage units here include not only a storage unit that merely stores items, but also a storage unit having a temperature adjustment function, etc. A storage unit system including various storage units is also provided.

SUMMARY

However, it has conventionally been a problem that a storage unit system as a whole has to be stopped when the configuration of the storage unit system is changed, such as an increase or a decrease in the number of storage units included in the storage unit system or a change in the functions of a storage unit. Stopping the entire storage unit system causes problems in the sustainable operation of the storage unit system as a whole.

In view of this, the present disclosure provides a control method and the related technologies that enable the operation of a storage unit system without stopping the entire storage unit system, even when the configuration of the storage unit system is changed.

A control method according to one aspect of the present disclosure is a control method of controlling, using a distributed ledger, locking or unlocking of one or more storage units, in each of which an item is storable. The control method includes: operating a first smart contract and one or more second smart contracts, by a code, stored in the distributed ledger, being executed by a computer, the first smart contract managing the one or more second smart contracts that are in one-to-one correspondence with the one or more storage units; controlling, by each of the one or more second smart contracts, locking or unlocking of a corresponding one of the one or more storage units, the controlling being performed under the management by the first smart contract; and controlling, by the first smart contract, whether to place each of the one or more second smart contracts under the management.

Note that this comprehensive or concrete aspect may be realized by a system, a method, an integrated circuit, a computer program, or a computer-readable recording medium such as a CD-ROM, or by any combination thereof.

With the control method according to the present disclosure, it is possible to operate a storage unit system without stopping the entire storage unit system, even when the configuration of the storage unit system is changed.

BRIEF DESCRIPTION OF DRAWINGS

These and other objects, advantages and features of the disclosure will become apparent from the following description thereof taken in conjunction with the accompanying drawings that illustrate a specific embodiment of the present disclosure.

FIG. 5 is an illustration of availability information of the storage unit system according to the embodiment;

FIG. 6 is an illustration of an address table according to the embodiment;

FIG. 7 is an illustration of function information according to the embodiment;

FIG. 15 is an illustration of availability information used in the management system according to Variation 1 of the embodiment;

Figure 1:
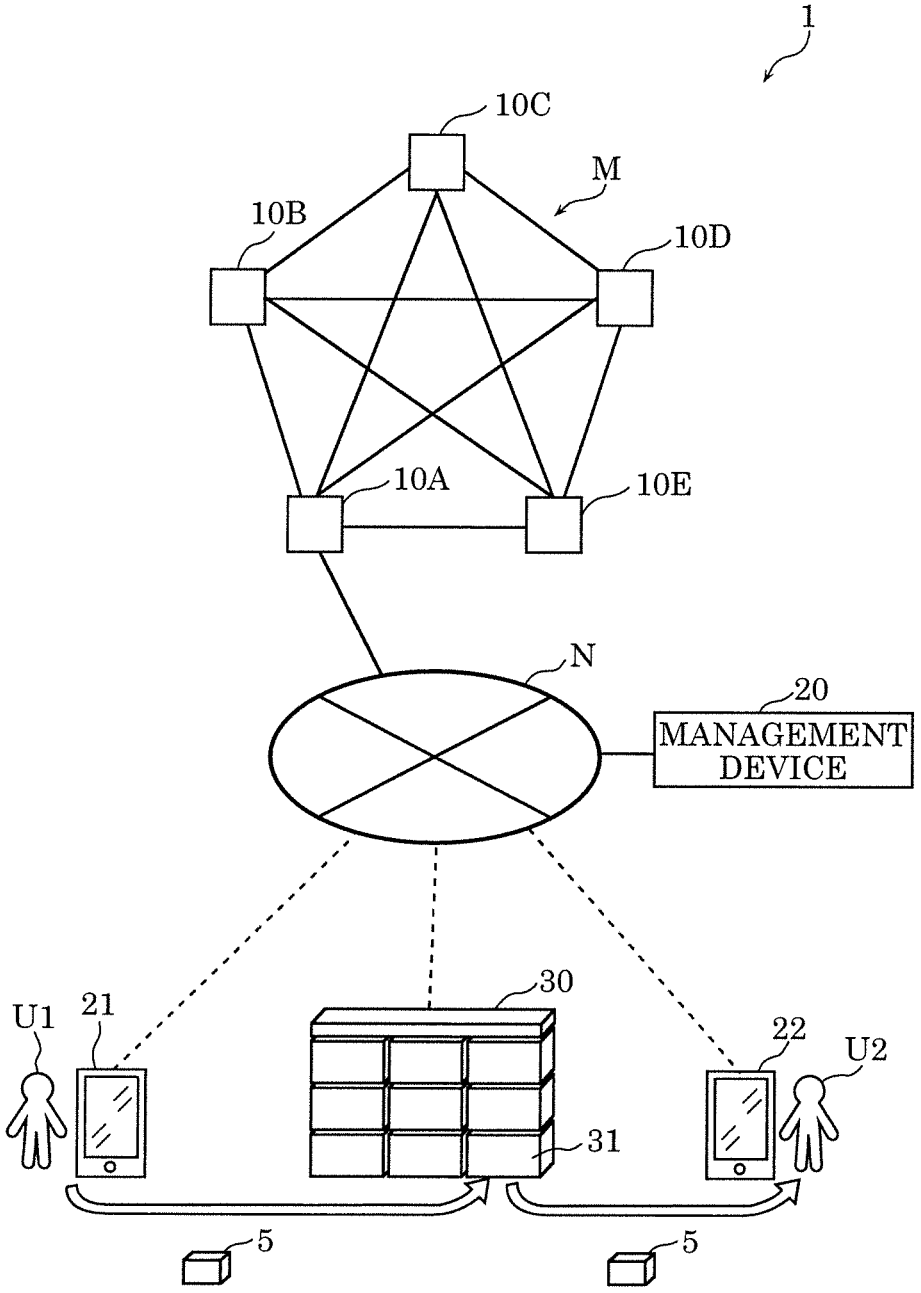
FIG. 1 is a block diagram schematically illustrating a configuration of a management system according to an embodiment.

DETAILED DESCRIPTION OF THE EMBODIMENT (Underlying Knowledge Forming Basis of the Present Disclosure) A control method according to one aspect of the present disclosure is a control method of controlling, using a distributed ledger, locking or unlocking of one or more storage units, in each of which an item is storable. The control method includes: operating a first smart contract and one or more second smart contracts, by a code, stored in the distributed ledger, being executed by a computer, the first smart contract managing the one or more second smart contracts that are in one-to-one correspondence with the one or more storage units; controlling, by each of the one or more second smart contracts, locking or unlocking of a corresponding one of the one or more storage units, the controlling being performed under the management by the first smart contract; and controlling, by the first smart contract, whether to place each of the one or more second smart contracts under the management.

According to the above-described aspect, the storage unit system is controlled by the first and second smart contracts. When a change such as adding or removing of a storage unit to or from the storage unit system or a change in the functions of a storage unit occurs, only the operation of a second smart contract related to the change needs to be stopped. Stated differently, it is possible to maintain the operations of the first smart contract and the second smart contracts that are unrelated to the change. Supposing that the storage unit system is controlled by a single smart contract, the operation of the smart contract needs to be stopped when, for example, a storage unit is to be added to the system, and this causes problems in the operation of the storage unit system. With the control method according to one aspect of the present disclosure, it is possible to operate the storage unit system without stopping the entire storage unit system, even when the configuration of the storage unit system is changed.

For example, the control method may further include: when a request to remove a storage unit from the one or more storage units is received by the first smart contract, excluding, from the management, a second smart contract, among the one or more second smart contracts, which corresponds to the storage unit to be removed.

According to the above-described aspect, when a storage unit is to be removed from the storage unit system, the second smart contract corresponding to the storage unit to be removed is excluded from the management. Thus, when a storage unit is to be removed from the storage unit system, it is possible to maintain the operations of the first smart contract and the second smart contracts that are not to be removed. Accordingly, it is possible to operate the storage unit system without stopping the entire storage unit system, even when the configuration of the storage unit system is changed.

For example, the control method may further include: when a request to add a new storage unit to the one or more storage units is received by the first smart contract, additionally placing, under the management, a second smart contract corresponding to the new storage unit.

According to the above-described aspect, when a storage unit is to be added to the storage unit system, the first smart contract additionally places, under the management, a second smart contract corresponding to the storage unit to be added. Thus, when a storage unit is to be added to the storage unit system, it is possible to maintain the operations of the first smart contract and the second smart contracts that are already in operation. Accordingly, it is possible to operate the storage unit system without stopping the entire storage unit system, even when the configuration of the storage unit system is changed.

For example, the control method may further include: when an inquiry on whether the one or more storage units are being used is received by the first smart contract, generating response information in response to the inquiry and transmitting the response information generated.

According to the above-described aspect, the first smart contract provides response information in response to an inquiry on the availability of storage units. Accordingly, it is possible to respond to such an inquiry, even when the configuration of the storage unit system is changed.

For example, the control method may further include the following executed by the first smart contract: managing availability information indicating whether the one or more storage units are being used; referring to the availability information, when a request to use one of the one or more storage units is received by the first smart contract; and (a) declining the request when the one of the one or more storage units is being used, and (b) accepting the request when the one of the one or more storage units is being unused.

According to the above-described aspect, it is possible to manage storage units so that the use of a storage unit is allowed when that storage unit is not being used. With this, it is possible to avoid the inconveniency such that caused by a storage unit being used by plural users.

For example, the accepting of the request when the one of the one or more storage units is being unused may include accepting the request only when processing of charging a fee for the use of the one of the one or more storage units is completed.

According to the above-described aspect, it is possible to carry out management so that a storage unit is used only when processing of charging a fee for the use of that storage unit is completed.

For example, the control method may further include: when an inquiry on a function of one of the one or more storage units is received by the first smart contract, transferring the inquiry to one of the one or more second smart contracts which corresponds to the one of the one or more storage units; and transmitting, as a response to the inquiry, response information obtained from the one of the one or more second smart contracts.

According to the above-described aspect, when an inquiry is made on the functions of a storage unit, a smart contract corresponding to the storage unit for which the inquiry has been made is caused to respond to the inquiry. With the management of information that is different from storage unit to storage unit, by the second smart contracts which are in one-to-one correspondence with the storage units, a function of the first smart contract needs to be added as least as possible. Accordingly, it is possible to operate the storage unit system without stopping the entire storage unit system, even when the configuration of the storage unit system is changed.

For example, the control method may further include: when a second smart contract is newly placed under the management by the first smart contract, causing a memory in the computer to additionally store an address of the second smart contract, the computer operating the first smart contract; and when one of the one or more second smart contracts is excluded from the management by the first smart contract, deleting an address of the one of the one or more second smart contracts from the memory in the computer operating the first smart contract.

According to the above-described aspect, whether to place a second smart contract under the management is controlled based on whether the computer is storing the address of the second smart contract in the memory. This makes it easier to achieve a configuration of a storage unit system, with which it is possible to operate the storage unit system without stopping the entire storage unit system, even when the configuration of the storage unit system is changed.

For example, in the control method, the operating of the first smart contract may include operating one or more first smart contracts each being the first smart contract. The control method may further include: operating a third smart contract that manages the one or more first smart contracts; and controlling, by the third smart contract, whether to place each of the one or more first smart contracts under the management.

According to the above-described aspect, the storage unit system is controlled by the first smart contracts, the second smart contracts, and the third smart contract. When a change such as adding or removing of a storage unit to or from the storage unit system or a change in the functions of a storage unit occurs, only the operation of the second smart contract related to the change needs to be stopped. Stated differently, it is possible to maintain the operations of the first smart contract, the third smart contract, and the second smart contracts unrelated to the change. Furthermore, since the third smart contract controls whether to place each of the first smart contracts under the management, it is possible to more easily control a plurality of first smart contracts.

An information processing device according to one aspect of the present disclosure is an information processing device that controls, using a distributed ledger, locking or unlocking of one or more storage units, in each of which an item is storable, the information processing device being one of a plurality of information processing devices. The information processing device includes: a processor; a memory; and a storage device in which the distributed ledger is stored, the distributed ledger storing a code. The processor operates a first smart contract and one or more second smart contracts by the code, stored in the distributed ledger, being executed using the memory, the first smart contract managing the one or more second smart contracts that are in one-to-one correspondence with the one or more storage units. Each of the one or more second smart contracts controls, under the management by the first smart contract, locking or unlocking of a corresponding one of the one or more storage units. The first smart contract controls whether to place each of the one or more second smart contracts under the management.

With such an information processing device, the same advantageous effects as those achieved by the above-described control method are produced.

A management system according to one aspect of the present disclosure includes: a plurality of information processing devices each being the above-described information processing device; and the one or more storage units of which locking or unlocking is controlled using the distributed ledger by the plurality of information processing devices.

With such a management system, the same advantageous effects as those achieved by the above-described control method are produced.

A recording medium according to one aspect of the present disclosure is a non-transitory computer-readable recording medium for use in a computer, the recording medium having a computer program recorded thereon for causing the computer to execute the above-described control method.

With such a recording medium, the same advantageous effects as those achieved by the above-described control method are produced.

Note that these comprehensive or concrete embodiments may be realized by a system, a method, an integrated circuit, a computer program, or a computer-readable recording medium such as a CD-ROM, or by any combination thereof.

The following describes in detail the embodiment with reference to the drawings.

Note that the embodiment described below shows a general or specific example. The numerical values, shapes, materials, structural elements, the arrangement and connection of the structural elements, steps, order of the steps, etc. indicated in the following embodiment are mere examples, and therefore are not intended to limit the scope of the present disclosure. Therefore, among elements in the following embodiments, those not recited in any of the independent claims representing the most generic concepts are described as optional structural elements.

Embodiment

This embodiment describes a control method and the related technologies that enable the operation of a storage unit system without stopping the entire storage unit system, even when the configuration of the storage unit system is changed. The control method according to this embodiment is a method of controlling, using a distributed ledger, locking or unlocking of one or more storage units, in each of which an item is storable. Note that the storage unit may be, for example, a delivery locker or a coin operated locker.

FIG. 1 is a block diagram schematically illustrating a configuration of management system 1 according to this embodiment.

As illustrated in FIG. 1, management system 1 includes servers 10A, 10B . . . and 10E, management device 20, terminals 21 and 22, and storage unit system 30. It should be noted that servers 10A, 10B . . . and 10E are also referred to as "server 10A and other servers" or "server 10A, etc.", and each of server 10A and other servers is also referred to as "server 10".

Management system 1 is a system that manages locking or unlocking of storage unit 31 when user U1 delivers item 5 to user U2 with the use of storage unit 31. The description is provided assuming that storage unit 31 is, for example, a delivery locker, and management system 1 manages one or more delivery lockers. When a receiver receives item 5 via a courier, for example, user U1 is the courier and user U2 is the receiver.

Each of server 10A and other servers is a server device which is an information processing device that manages, using a distributed ledger and on a computer, locking or unlocking of storage units 31 included in storage unit system 30. Each of server 10A and other servers has a ledger for locking or unlocking management, and updates a ledger of its own in synchronization with the ledgers of other servers. A distributed ledger is advantageous in that it is difficult to tamper information recorded therein, and can be achieved by known technology such as blockchain, IOTA, or Hashgraph.

A ledger held by each of server 10A and other servers stores information indicating whether each of storage units 31 is locked or unlocked, and also stores contract codes which are program codes for managing storage units 31. Each of server 10A and other servers manages locking or unlocking of storage units 31 using smart contracts each having a function operated by the execution of a contract code. Server 10A and other servers are communicably connected to terminals 21 and 22, and storage unit system 30 via network N. Server 10A and other servers are connected with one another via network M so that they can communicate with one another. It should be noted that network M may be connected to network N or may be network N.

Management device 20 is a device that manages, using a computer, storage unit system 30 and storage units 31. Management device 20 updates ledgers managed by server 10A and other servers, when a storage unit is to be added or removed to or from storage unit system 30. Management device 20 updates information in a ledger based on an operation by the manager of storage unit system 30, for instance.

Each of terminals 21 and 22 is an information processing terminal that receives an operation for locking or unlocking storage unit 31 from a user, and transmits information related to the operation to server 10A and other servers. Here, terminal 21 is a terminal held by user U1 who delivers item 5, and terminal 22 is a terminal held by user U2 who receives item 5. Terminals 21 and 22 are, for example, smart phones or personal computers.

Storage unit system 30 is a system that includes one or more storage units 31. Each of one or more storage units 31 included in storage unit system 30 is a place for temporarily storing item 5 when user U1 delivers item 5 to user U2. It is assumed that the number of persons authorized to lock or unlock storage unit 31 at a time is limited to a predetermined number. The description here provides the case where the predetermined number is one, but the number is not limited to one.

Storage unit 31 has at least a storage space for storing item 5. Storage unit 31 may further have a temperature adjustment function to adjust the temperature of a storage space or a function to produce effects such as sounds, light, smell, or smoke at the time of locking or unlocking. The locking or unlocking of storage units 31, the temperature adjustment function, and the function to produce the effects are controlled by the smart contracts operated by server 10A, etc.

Storage unit 31 is unlocked based on an operation by user U1 and is locked after item 5 has been stored by user U1. Subsequently, storage unit 31 is unlocked based on an operation by user U2 and item 5 is taken out by user U2.

Figure 2:
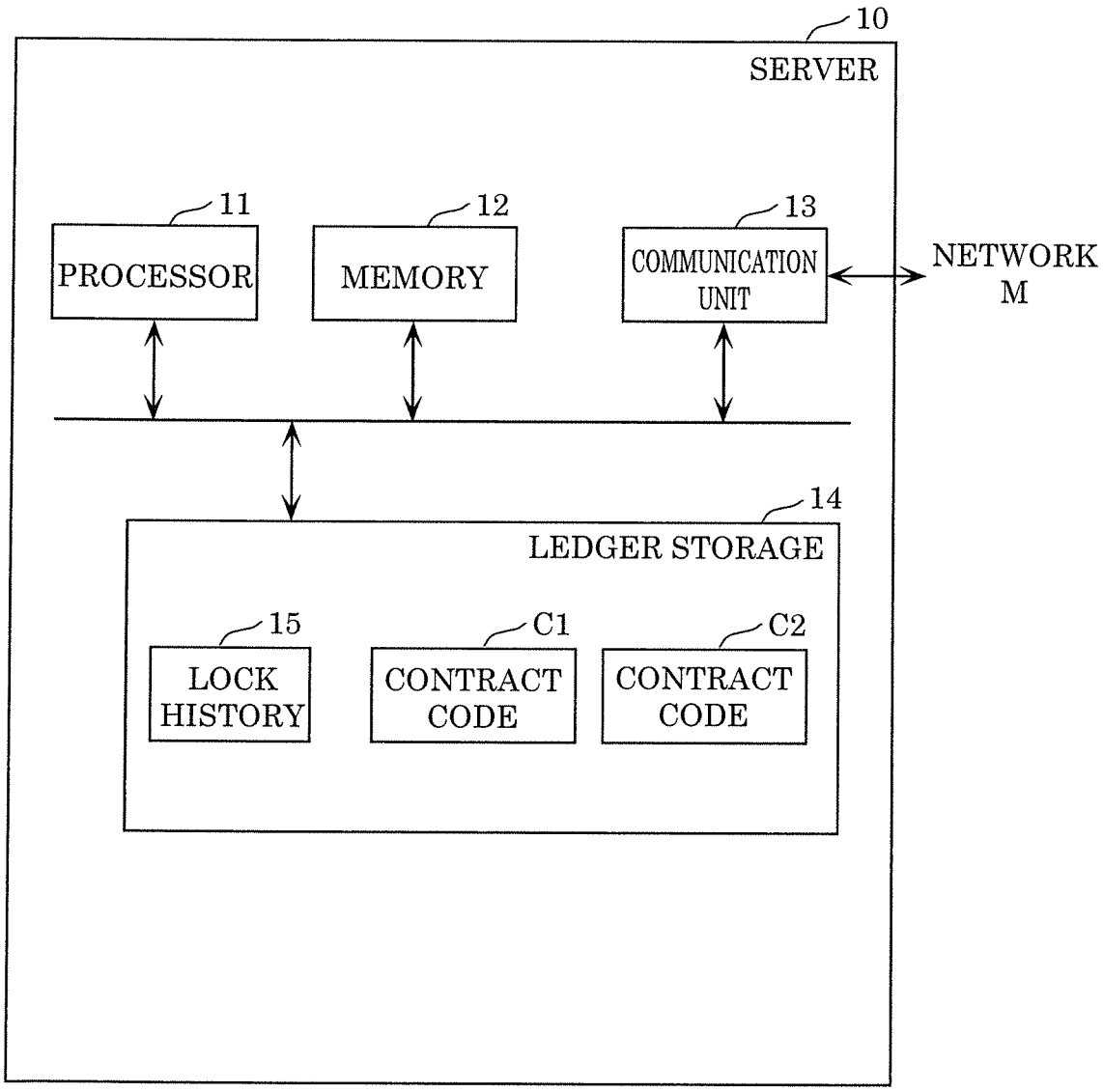
FIG. 2 is a block diagram illustrating a hardware configuration of a server according to the embodiment.
Figure 3:
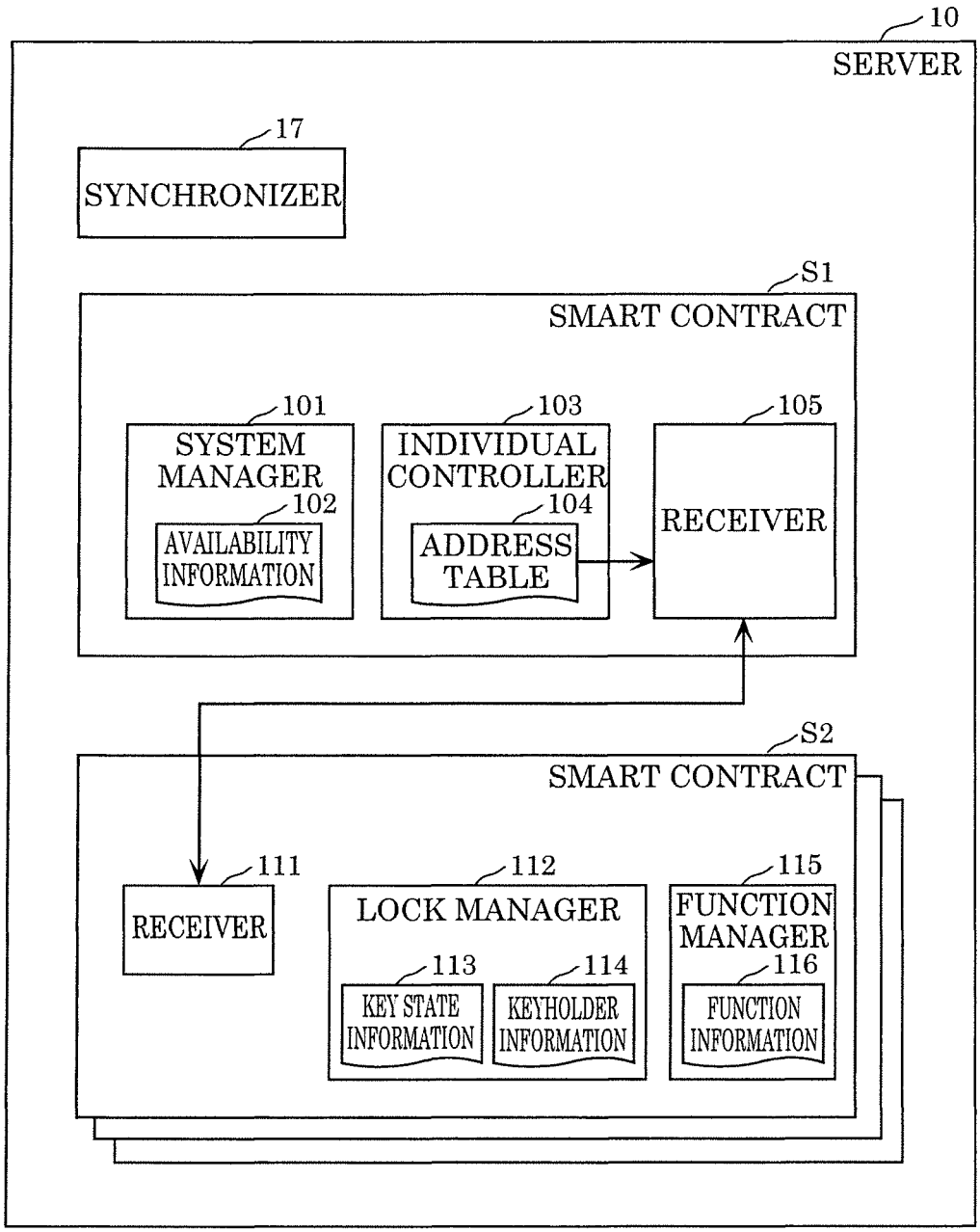
FIG. 3 is a block diagram illustrating a functional configuration of the server according to the embodiment.

FIG. 2 is a block diagram illustrating a hardware configuration of server 10 according to this embodiment. FIG. 3 is a block diagram illustrating a functional configuration of server 10 according to this embodiment. Here, server 10 corresponds to each of server 10A and other servers illustrated in FIG. 1.

As illustrated in FIG. 2, server 10 includes processor 11, memory 12, communication unit 13, and ledger storage 14.

Processor 11 is a processor that executes a program using memory 12. Processor 11 operates smart contract S1 and smart contracts S2, by executing contract codes C1 and C2, respectively, which are stored in ledger storage 14 (see FIG. 3). In addition, processor 11 achieves other functions of server 10, by executing a predetermined program.

Memory 12 is a work area to be used when processor 11 executes a program.

Communication unit 13 is a communication interface device communicably connected to other devices. Communication unit 13 is directly or indirectly connected to networks N and M, and is capable of communicating with others such as servers 10, terminals 21 and 22, and storage unit system 30 via networks N and M.

Ledger storage 14 is a storage device that stores a ledger for managing locking or unlocking of storage units 31. Ledger storage 14 is achieved by a hard disk drive (HDD), a solid state drive (SSD), or the like.

Ledger storage 14 stores lock history 15 and contract codes C1 and C2. Lock history 15 is a history of locking and unlocking storage units 31 and is also a history of the keyholders of storage units 31. Contract codes C1 and C2 are program codes for operating smart contract S1 and smart contracts S2, respectively.

Next, the functions of server 10 will be described.

As illustrated in FIG. 3, server 10 includes synchronizer 17, smart contract S1, and smart contracts S2. Server 10 operates smart contract S1 that may manage one or more smart contracts S2, and smart contracts S2 that are in one-to-one correspondence with storage units 31. Stated differently, server 10 controls storage unit system 30 using smart contract S1 and smart contracts S2 that are configured to have a hierarchical structure.

Synchronizer 17 is a processing unit that synchronizes ledger storages 14 among servers 10. Synchronizer 17 can be achieved by a predetermined program being executed by processor 11.

Synchronizer 17 attempts to reach a consensus on information to be stored in ledger storage 14 with other servers 10, based on a consensus algorithm at predetermined time intervals. Synchronizer 17 subsequently stores new information in ledger storage 14 when the consensus is successfully reached. The consensus algorithm such as proof of work (POW), proof of stake, or practical *byzantine* fault tolerance (PBFT) which has conventionally been suggested for use is applicable.

Smart contract S1 includes system manager 101, individual controller 103, and receiver 105. Smart contract S1 manages storage unit system 30 as a whole, and it is assumed that smart contract S1 continues to operate even when storage unit 31 is added or removed to or from storage unit system 30. Smart contract S1 controls whether to place each of one or more smart contracts S2 under its management. Smart contract S1 corresponds to the first smart contract.

System manager 101 manages attribute information such as identification information and location of storage unit system 30, and availability information 102 indicating whether each of storage units 31 included in storage unit system 30 is being used. When receiving an inquiry on the attribute information and availability information 102 of storage unit system 30 from terminal 21 or the like, system manager 101 generates response information based on the attribute information and availability information 102 that are under its management, and transmits the generated response information to terminal 21 or the like. In addition, system manager 101 receives a request to use at least one storage unit 31 from terminal 21 or the like, and updates availability information 102.

Specifically, when receiving, from terminal 21, an inquiry on whether at least one storage unit 31 is being used, system manager 101 generates response information in response to the inquiry, and transmits the generated response information to terminal 21. When receiving a request to use at least one storage unit 31, system manager 101 refers to availability information 102. System manager 101 declines the request when storage unit 31 of which the use has been requested is being used, and accepts the request when that storage unit 31 is not being used. Note that when storage unit 31 of which the use has been requested is not being used, system manger 101 may accept the request only when processing of charging a fee for this new use is completed.

Individual controller 103 is a processing unit that controls whether to place, under its management, each of storage units 31 included in storage unit system 30. Individual controller 103 has address table 104 on memory 12. Address table 104 stores the storage addresses of smart contracts S2 that are in one-to-one correspondence with storage units 31 placed under the management of individual controller 103.

Specifically, when receiving, from management device 20, a deletion request to delete storage unit 31, individual controller 103 excludes, from the management, smart contract S2 corresponding to storage unit 31 to be deleted. In order to exclude smart contract S2 from the management, individual controller 103 deletes, from address table 104, the address of smart contract S2 to be deleted. In addition, when receiving, from management device 20, an addition request to add new storage unit 31, individual controller 103 additionally places, under the management, smart contract S2 corresponding to new storage unit 31. In order to additionally place smart contract S2 under the management, individual controller 103 causes memory 12 to additionally store the address of that smart contract S2 in address table 104.

Receiver 105 is a processing unit that receives an inquiry on the functions of storage unit 31. When receiving an inquiry on the functions of storage unit 31, receiver 105 reads, from address table 104, the address of smart contract S2 corresponding to storage unit 31 for which the inquiry has been made, and transfers the received inquiry to that address. Response information is transmitted to terminal 21 or the like in response to the inquiry as a result of the transfer.

Smart contract S2 includes receiver 111, lock manager 112, and function manager 115. Smart contracts S2 are in one-to-one correspondence with storage units 31, and one smart contract S2 operates in charge of one storage unit 31. It is assumed that smart contract S2 starts operating when storage unit 31 corresponding to that smart contract S2 is added to storage unit system 30, and ends the operation when that storage unit 31 is removed from storage unit system 30. Smart contract S2 corresponds to the second smart contract.

Receiver 111 is a processing unit that receives an inquiry on the functions of storage unit 31. When receiving inquiry information related to the functions of storage unit 31, which is transferred from receiver 105 in smart contract S1, receiver 111 generates response information in response to the inquiry and transmits the generated response information to receiver 105. The inquiry information related to the functions is, for example, information indicating whether storage unit 31 has a refrigerating function, a heat preservation function, or a function to produce effects, e.g., sounds, etc.

For example, when receiving an inquiry that includes a function ID, from terminal 21 or the like, for example, receiver 111 refers to function manager 115, determines whether storage unit 31 has a function defined by the function ID, and transmits response information indicating the result of the determination. When storage unit 31 has the function defined by the function ID, receiver 111 generates response information which includes "TRUE", and when storage unit 31 does not have that function, receiver 111 generates response information which includes "FALSE". Function ID defines, for example, a refrigerating function as "1001", a heat preservation function as "1002", and a function to produce effects, e.g., sounds, etc. as "1003".

Lock manager 112 is a processing unit that manages locking or unlocking of storage unit 31 corresponding to one of smart contracts S2. Lock manager 112 manages key state information 113 indicating whether that storage unit 31 is locked or unlocked, and keyholder information 114 indicating, as a keyholder, a person authorized to lock or unlock that storage unit 31. Key state information 113 and keyholder information 114 may be derived from lock history 15 stored in ledger storage 14.

When receiving a lock or unlock request to lock or unlock storage unit 31 corresponding to one of smart contracts S2, lock manager 112 verifies the validity of the request, subsequently adds, as a history to lock history 15, that the lock or unlock request has been received, and updates key state information 113 to indicate that storage unit 31 is locked or unlocked. Note that key state information 113 is referred to by lock controller 33 of storage unit 31 and is reflected on the locking or unlocking control of storage unit 31 performed by lock controller 33. It can be therefore said that lock manager 112 controls the locking or unlocking of storage unit 31 via lock controller 33.

When the keyholder of storage unit 31 is changed, lock manager 112 adds a history to lock history 15 in accordance with the change, and also updates key state information 113 according to the change resulting from the request. When user U2 delivers item 5 to user U1, for example, the keyholder of storage unit 31 is changed from user U1 who has been the keyholder of storage unit 31 to user U2 after item 5 is stored in storage unit 31.

Function manager 115 is a processing unit that manages the control of the functions of storage unit 31. Function manager 115 separately manages control on the functions of storage unit 31 such as a refrigerating function, a heat preservation function, and a function to produce effects, e.g., sounds, etc., based on instruction information received from terminal 21 or the like. Specifically, function manager 115 has, for each of the functions of storage unit 31, function information 116 indicating whether a function of storage unit 31 is working, and updates function information 116 when receiving instruction information. Note that function manager 115 is not a requisite element.

Note also that this embodiment describes the case where smart contract S1 manages the availability information of storage unit system 30 as a whole. Each of smart contracts S2, instead of smart contract S1, may manage the availability information of the corresponding storage unit, and smart contract S1 may make an inquiry to each of smart contracts S2 to collect the availability information of all of storage units 31.

Figure 4:
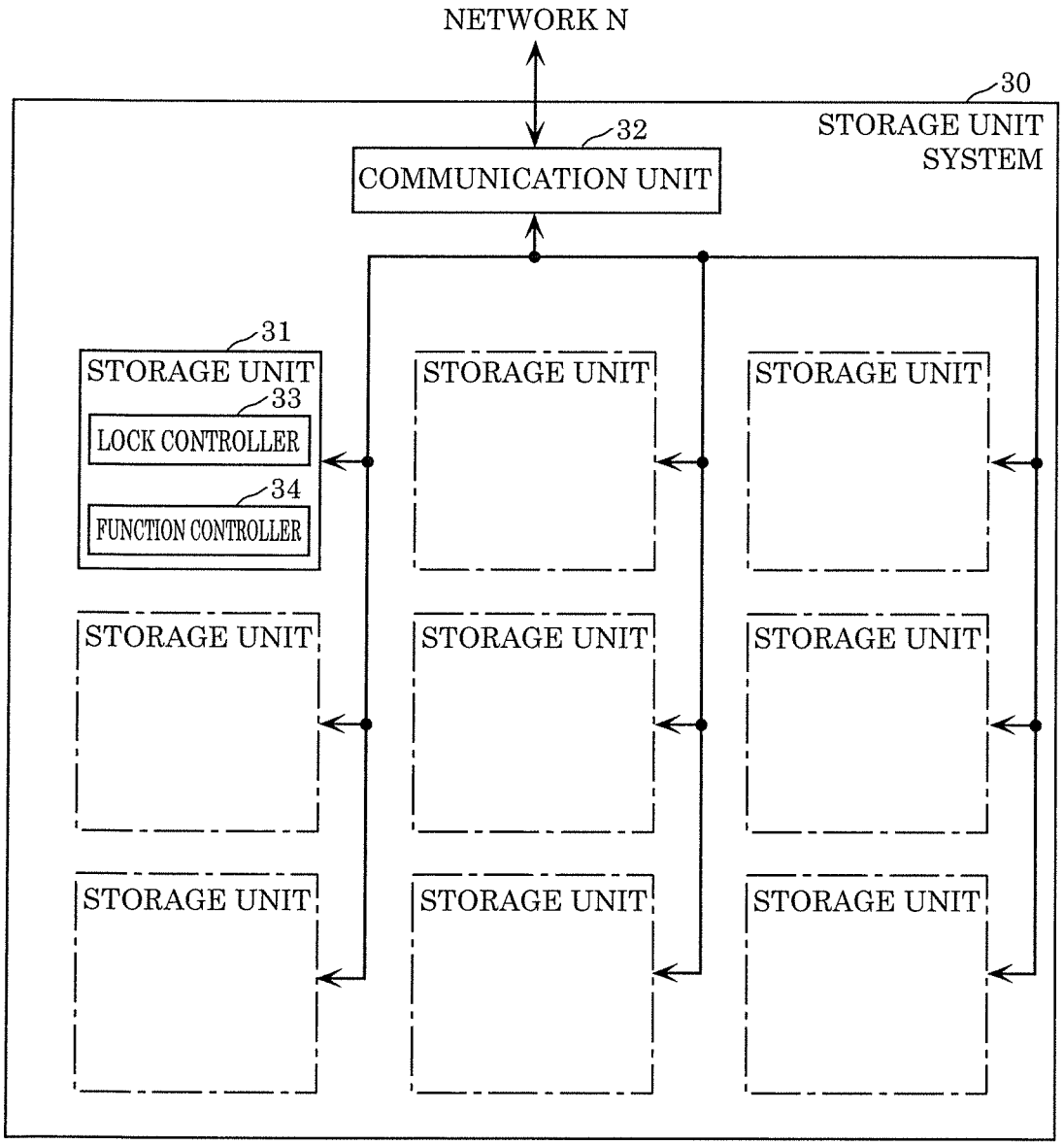
FIG. 4 is a block diagram schematically illustrating a configuration of a storage unit system according to the embodiment.

FIG. 4 is a block diagram schematically illustrating a configuration of storage unit system 30 according to this embodiment.

As illustrated in FIG. 4, storage unit system 30 includes communication unit 32, lock controller 33, and function controller 34. Lock controller 33 and function controller 34 are provided one for each of one or more storage units 31 included in storage unit system 30.

Communication unit 32 is a communication interface device communicably connected to other devices. Communication unit 32 is connected to network N and is capable of communicating with other servers 10 via network N.

Lock controller 33 is provided for each storage unit 31 and controls whether to lock or unlock storage unit 31. Lock controller 33 repeatedly refers to key state information 113 in server 10 via communication unit 32, and changes the key state of storage unit 31 to be in accordance with key state information 113.

Specifically, when key state information 113 indicates that storage unit 31 is unlocked, and storage unit 31 is actually unlocked, lock controller 33 keeps the unlocked state, but when storage unit 31 is actually locked, unlocks storage unit 31 so that storage unit 31 is unlocked. When key state information 113 indicates that storage unit 31 is locked, and storage unit 31 is actually locked, lock controller 33 keeps the locked state, but when storage unit 31 is actually unlocked, locks storage unit 31 so that storage unit 31 is locked.

Function controller 34 is a processing unit that controls the functions of storage unit 31. When storage unit 31 has functions such as a refrigerating function, a heat preservation function, and a function to produce effects, e.g., sounds, etc., function controller 34 controls so that these functions of storage unit 31 work. Note that function controller 34 is not a requisite element.

Function controller 34 repeatedly refers to function information 116 in server 10 via communication unit 32 in the same manner as lock controller 33 refers to key state information 113, and changes the state of the functions in accordance with function information 116 so that the functions of storage unit 31 work or do not work.

FIG. 5 is an illustration of availability information 102 of storage unit 31 in management system 1 according to this embodiment.

Availability information 102 has entries each being in one-to-one correspondence with storage units 31, and includes information such as storage ID 41 and used/unused 42.

Storage ID 41 is an identifier capable of uniquely identifying storage unit 31. Storage ID 41 indicates an identifier of each of one or more storage units 31 that are in one-to-one correspondence with one or more smart contracts S2.

Used/unused 42 is information indicating whether storage unit 31 is being used.

When system manager 101 receives availability inquiry information from terminal 21, availability information 102 is referred to for the generation of response information. When system manager 101 receives a use request to use storage unit 31 from terminal 21 or the like, availability information 102 is updated.

FIG. 6 is an illustration of address table 104 according to this embodiment.

As illustrated in FIG. 6, address table 104 stores address 1, address 2 . . . and address n as each of the addresses of one or more smart contracts S2.

The addresses of smart contracts S2 under the management of smart contract S1 are written into address table 104 by individual controller 103. When receiver 105 receives an inquiry on the functions of storage unit 31, address table 104 is referred to by receiver 105 and the inquiry is transferred to the address of smart contract S2 corresponding to storage unit 31 for which the inquiry has been received.

FIG. 7 is an illustration of function information 116 according to this embodiment.

As illustrated in FIG. 7, function information 116 has entries each corresponding to one function, and includes information such as function ID 44 and state 45.

Function ID 44 is information indicating a function of storage unit 31. For example, according to function ID 44, "1001" indicates a refrigerating function and "1002" indicates a heat preservation function.

State 45 is information indicating whether a function of storage unit 31 indicated in the entry of function ID 44 is "ON" which is a state in which the function is working or "OFF" which is a state in which that function is not working.

Function information 116 illustrated in FIG. 7 indicates that storage unit 31 has a refrigerating function and a heat preservation function. Function information 116 indicates that the refrigerating function is on, that is, a storage space is being cooled by the refrigerating function, and also indicates that the heat preservation function is off.

Next, the following describes processing performed by management system 1 when storage unit 31 is to be added or removed to or from storage unit system 30.

Figure 8:
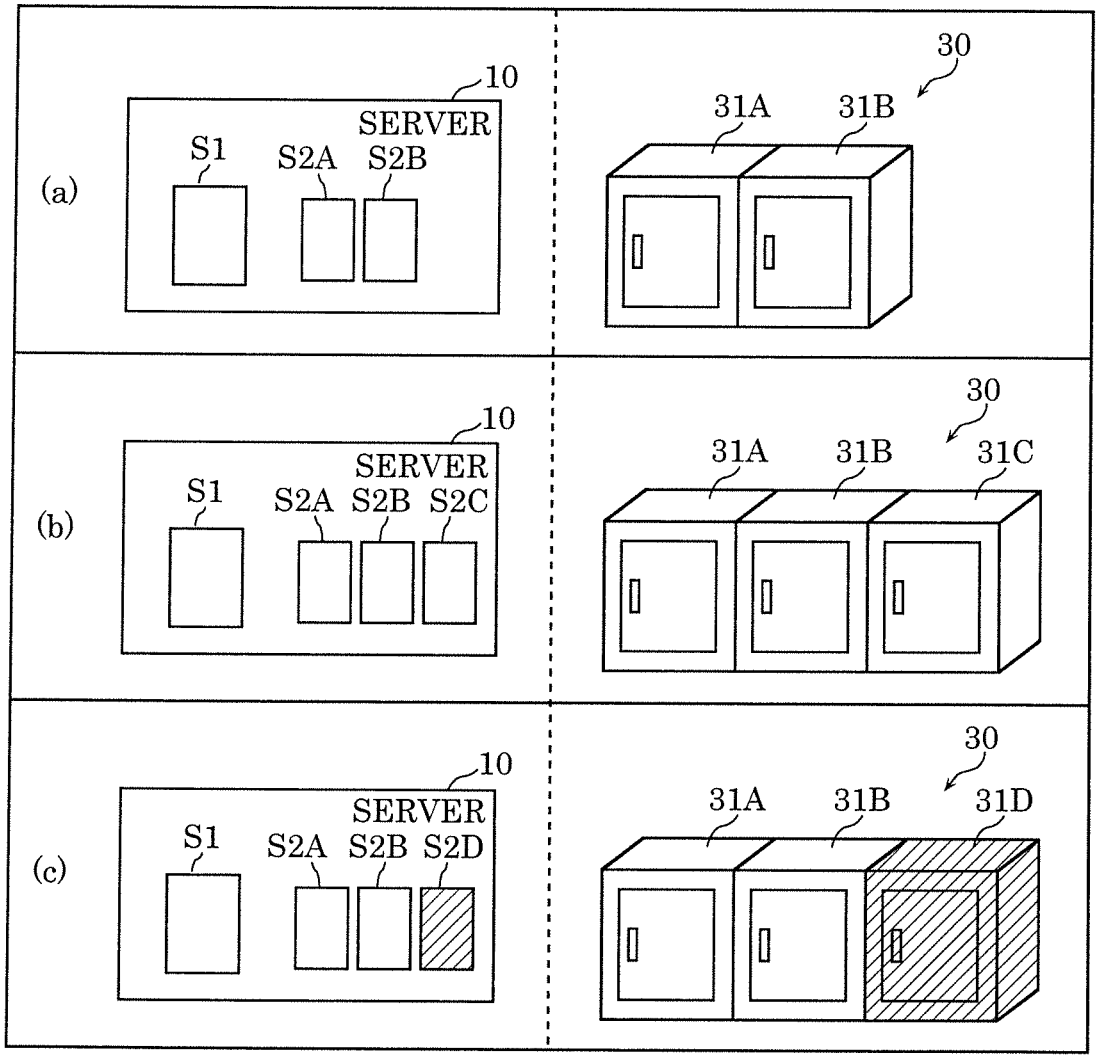
FIG. 8 is an illustration for explaining the case of adding or removing a storage unit to or from the storage unit system according to the embodiment.

FIG. 8 is an illustration for explaining the case of adding or removing storage unit 31 to or from storage unit system 30 according to this embodiment.

(a) in FIG. 8 illustrates storage unit system 30 that includes two storage units 31 that are storage units 31A and 31B. Here, server 10 operates smart contract S1 and smart contracts S2A and S2B corresponding to two storage units 31A and 31B, respectively.

(b) in FIG. 8 illustrates storage unit system 30 that includes three storage units 31 that are storage units 31A, 31B, and 31C. Here, server 10 operates smart contract S1 and smart contracts S2A, S2B, and S2C corresponding to three storage units 31A, 31B, and 31C, respectively.

When storage unit 31C is added to storage unit system 30 in the state illustrated in (a) in FIG. 8, the state is changed to the state illustrated in (b) in FIG. 8. When storage unit 31C is removed from storage unit system 30 in the state illustrated in (b) in FIG. 8, the state is changed to the state illustrated in (a) in FIG. 8.

The following describes processing performed by management system 1 when storage unit 31 is to be added or removed to or from storage unit system 30.

Figure 9:
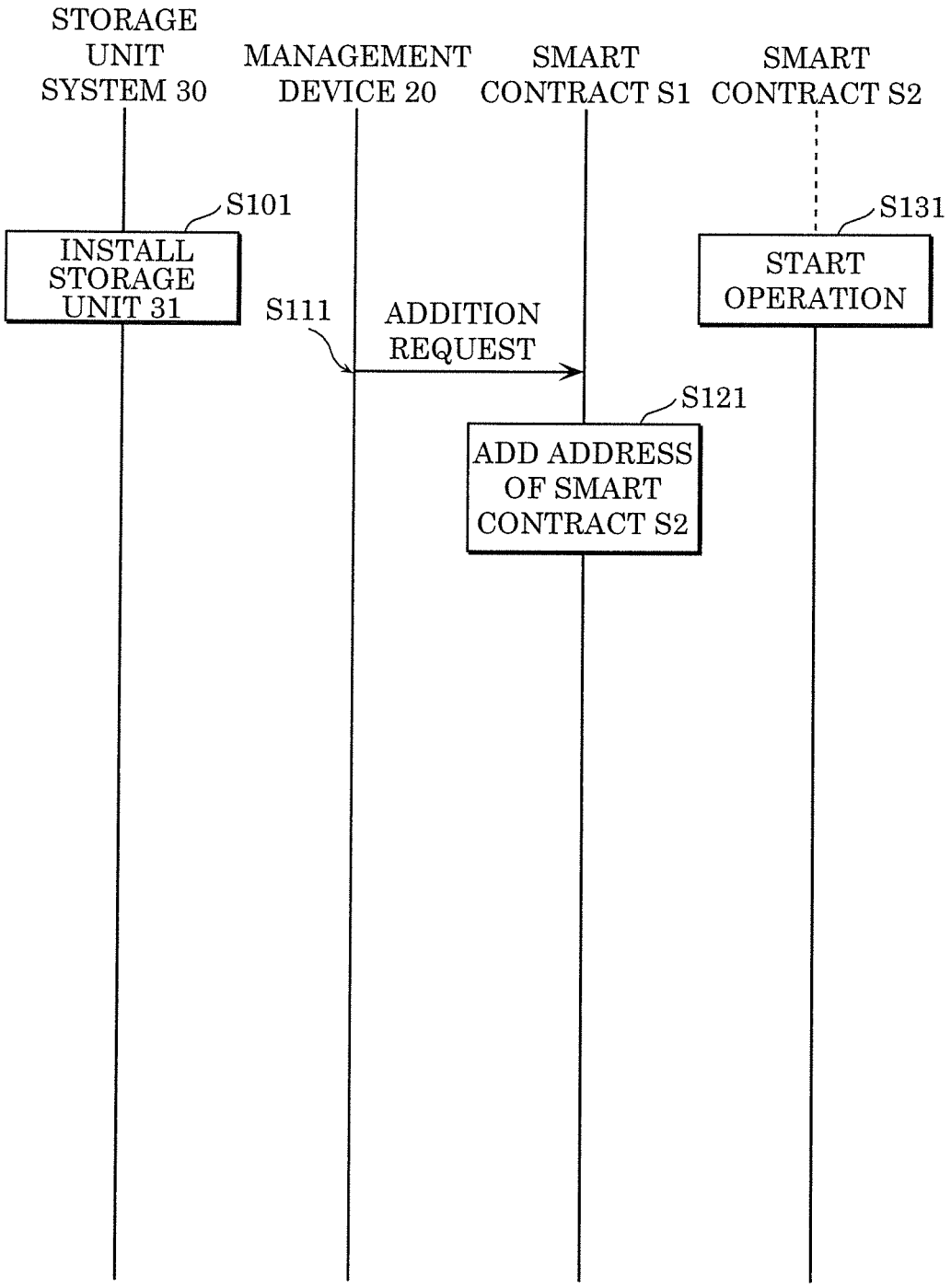
FIG. 9 is a sequence diagram illustrating processing performed when a storage unit is to be added to the storage unit system according to the embodiment.

FIG. 9 is a sequence diagram illustrating processing performed when storage unit 31 is to be added to storage unit system 30 according to this embodiment.

As illustrated in FIG. 9, when storage unit 31 is to be added to storage unit system 30, new storage unit 31 (e.g., storage unit 31C in (b) in FIG. 8) is physically installed in storage unit system 30 by the manager of management system 1 in step S101.

In step S111, management device 20 transmits, to smart contract S1, addition request information indicating an addition request to add storage unit 31 to storage unit system 30. Individual controller 103 in smart contract S1 receives the addition request information.

In step S131, smart contract S2 corresponding to new storage unit 31 starts operating. Note that when smart contract S2 is already in operation, the execution of step S131 is unnecessary.

In step S121, individual controller 103 in smart contract S1 adds, to address table 104, the address of smart contract S2 corresponding to new storage unit 31. Smart contract S1 thus places smart contract S2 corresponding to new storage unit 31 under its management.

With the processing illustrated in FIG. 9, new storage unit 31 is added to storage unit system 30 and is placed under the management by management system 1.

Figure 10:
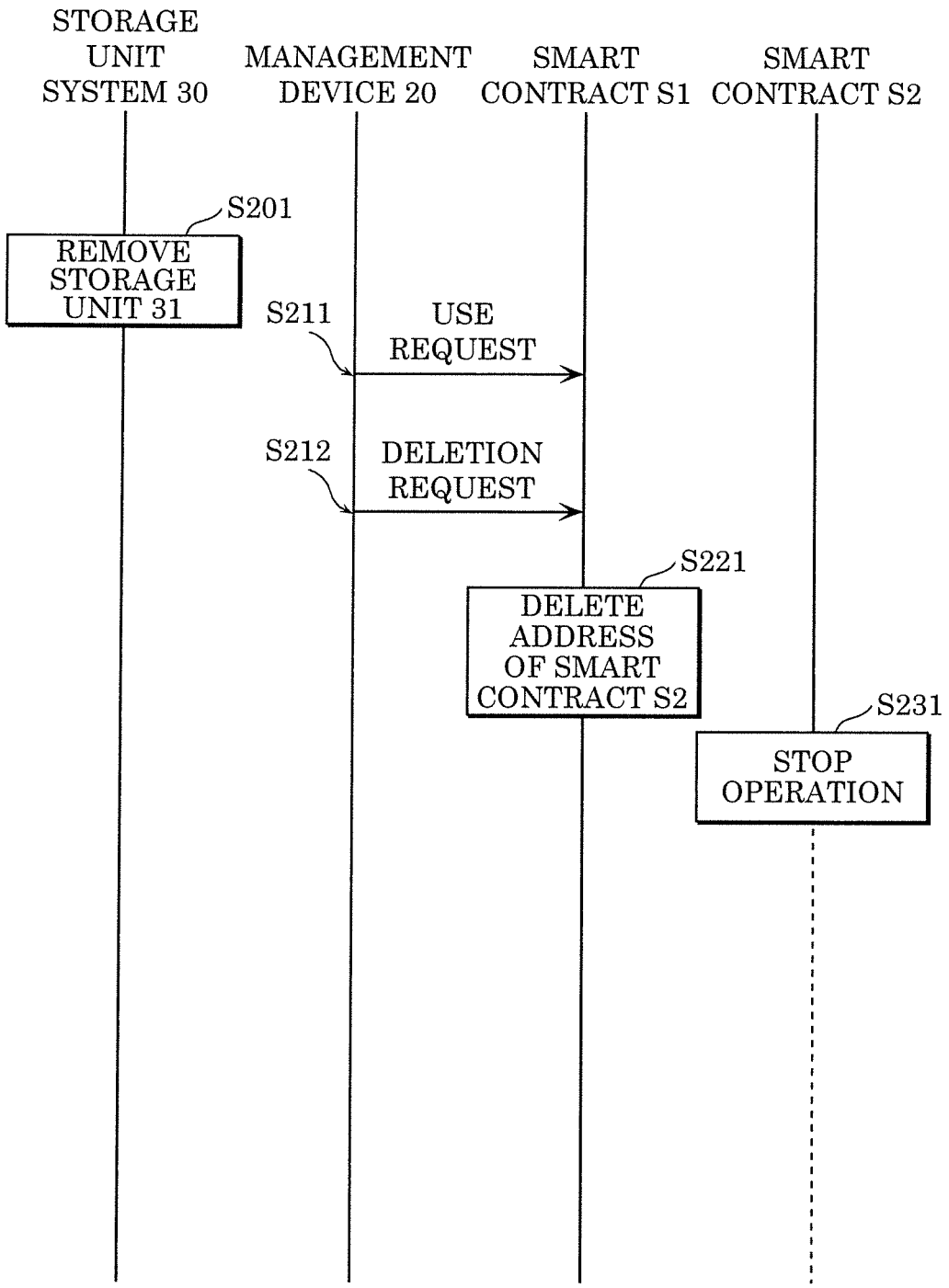
FIG. 10 is a sequence diagram illustrating processing performed when a storage unit is to be removed from the storage unit system according to the embodiment.

FIG. 10 is a sequence diagram illustrating processing performed when storage unit 31 is to be removed from storage unit system 30 according to this embodiment.

As illustrated in FIG. 10, when storage unit 31 is to be removed from storage unit system 30, storage unit 31 (e.g., storage unit 31C in (b) in FIG. 8) included in storage unit system 30 is physically removed from storage unit system 30 in step S201.

In step S211, management device 20 transmits, to smart contract S1, use request information indicating a use request to use storage unit 31. This is to prevent storage unit 31 to be removed from being used by user U1 or the like.

In step S212, management device 20 transmits, to smart contract S1, deletion request information indicating a deletion request to delete the address of smart contract S2 corresponding to storage unit 31 to be removed from storage unit system 30. Individual controller 103 in smart contract S1 receives the deletion request information.

In step S221, individual controller 103 in smart contract S1 deletes, from address table 104, the address of smart contract S2 corresponding to storage unit 31 to be removed from storage unit system 30. Smart contract S1 thus excludes, from the management, smart contract S2 corresponding to storage unit 31 to be removed from storage unit system 30.

In step S231, smart contract S2 corresponding to storage unit 31 to be removed from storage unit system 30 stops operating. The execution of step S231 is not requisite.

With the processing illustrated in FIG. 10, storage unit 31 is removed from storage unit system 30 and is excluded from the management by management system 1.

Next, the following describes the processing performed by management system 1 when storage unit 31 is to be used.

Figure 11:
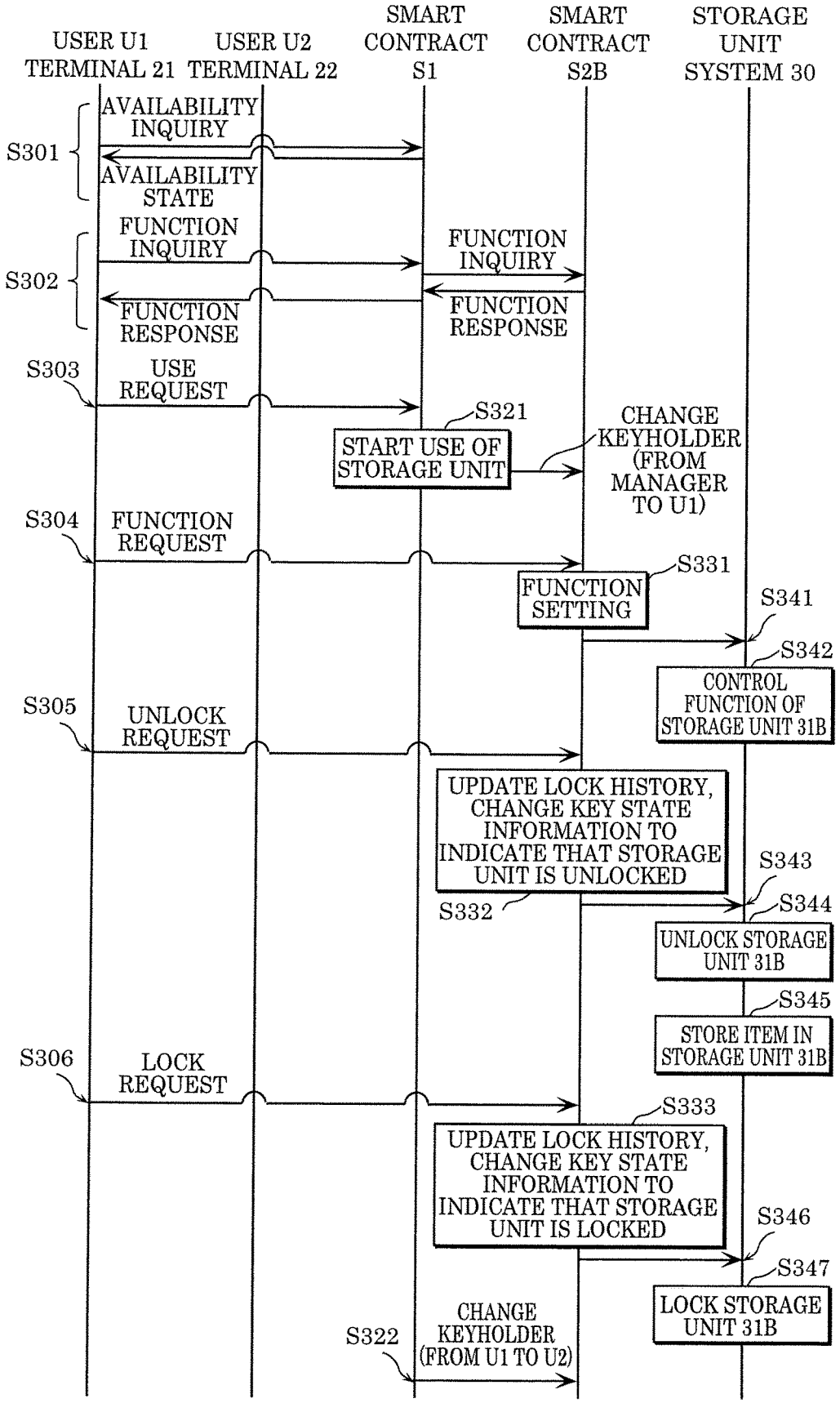
FIG. 11 is a first sequence diagram illustrating processing performed when a storage unit is to be used, according to the embodiment.
Figure 12:
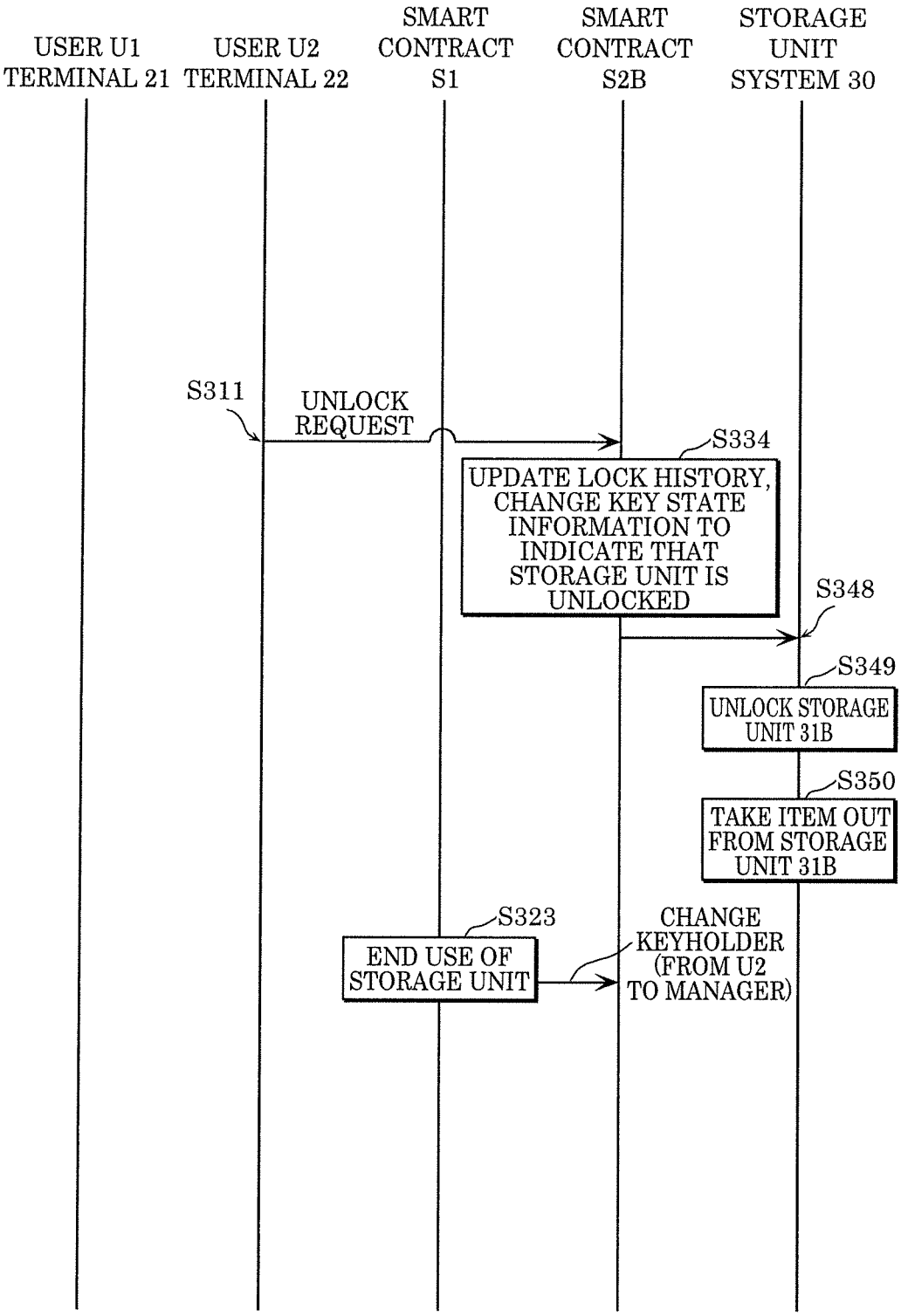
FIG. 12 is a second sequence diagram illustrating processing performed when storage is to be used, according to the embodiment.

FIG. 11 and FIG. 12 are each a sequence diagram illustrating processing performed when storage unit 31 is to be used, according to the embodiment. When processing illustrated in FIG. 11 is ended, the operation of management system 1 proceeds to processing illustrated in FIG. 12.

The following describes the processing performed when storage unit 31 is to be used, assuming the case where user U1 delivers item 5 to user U2 via storage unit 31B in the situation where storage units 31A and 31C are being used and storage unit 31B is not being used among one or more storage units 31. It is also assumed that item 5 needs to be refrigerated.

In step S301, user U1 transmits, to smart contract S1 via terminal 21, availability inquiry information for making an inquiry on whether storage units 31 included in storage unit system 30 are being used. When receiving the availability inquiry information, smart contract S1 transmits, to terminal 21, availability information indicating whether storage units 31 are being used. Smart contract S1 also transmits, to terminal 21, the address of smart contract S2 corresponding to storage unit 31B that is available. For example, smart contract S1 transmits, to terminal 21, availability information indicating that storage units 31A and 31C are being used and storage unit 31B is not being used among storage units 31A, 31B, and 31C. Smart contract S1 also transmits the address of smart contract S2 corresponding to storage unit 31B. User U1 can know that storage unit 31B is available for storing item 5.

In step S302, user U1 transmits, to smart contract S1 via terminal 21, function inquiry information for making an inquiry on whether storage unit 31 has a refrigerating function. Receiving the function inquiry information, smart contract S1 transfers the received function inquiry information to smart contract S2B corresponding to storage unit 31B.

Having received the function inquiry information, smart contract S2B checks what is indicated by the function inquiry information, and transmits, to smart contract S1, function response information indicating that storage unit 31B has a refrigerating function. Having received the function response information, smart contract S1 transfers the received function response information to terminal 21. Smart contract S2B transmits, for example, function response information indicating that storage unit 31B has a refrigerating function. Since storage unit 31B has a refrigerating function, user U1 knows that storage unit 31B is available for delivering item 5 to user U2, and determines to use storage unit 31B.

Note that by making an inquiry on whether storage unit 31 having a specific function is being used, the processing in steps S301 and S302 may be carried out at a time instead of being carried out separately.

In step S303, user U1 transmits use request information for using storage unit 31B to smart contract S1. Smart contract S1 receives the use request information.

In step S321, in response to the reception of the use request information in step S303, smart contract S1 performs processing of starting the use of storage unit 31B. In the starting processing, smart contract S1 transmits, to smart contract S2B, holder change request information indicating that the keyholder of storage unit 31B is to be changed from the manager to user U1. Receiving the holder change request information, smart contract S2B changes the keyholder of storage unit 31B from the manager to user U1 based on the received holder change request information.

In step S304, user U1 transmits, to smart contract S2B via terminal 21, function request information for setting the functions of storage unit 31B. For example, user U1 transmits, to smart contract S2B, function request information indicating that a storage space in storage unit 31B is to be refrigerated by a refrigerating function. Note that the temperature of the storage space in storage unit 31B may be set so that the temperature changes with time. For example, the temperature of the storage space may be gradually changed from low temperature to normal temperature as the time to take item 5 out from storage unit 31B approaches. To specify the time when user U2 takes item 5 out from storage unit 31B, a predetermined time may be acquired or a current position of terminal 22 carried by user U2 may be acquired using a global positioning system (GPS) so that the time when user U2 arrives at the location of storage unit 31B is specified using the acquired position and the moving speed of user U2.

In step S331, smart contract S2 receives the function request information and changes function information 116 of storage unit 31B based on the received function request information. A refrigerating function is changed to an on-state according to the function request information, for example.

In step S341, function controller 34 in storage unit system 30 refers to function information 116 held by smart contract S2B and determines that function information 116 of storage unit 31B has been updated to indicate that the refrigerating function is ON.

In step S342, function controller 34 controls so that the refrigerating function of storage unit 31B works. This is carried out based on the fact that function controller 34 has determined, in step S341, that function information 116 of storage unit 31B is updated to indicate that the refrigerating function is ON.

In step S305, user U1 controls unlocking of storage unit 31B via terminal 21. In the unlocking control, terminal 21 transmits an unlock request to unlock storage unit 31B to smart contract S2B.

In step S332, smart contract S2B updates lock history 15 by adding information indicating that the unlock request has been received, and changes key state information 113 to indicate that storage unit 31B is unlocked.

In step S343, lock controller 33 in storage unit system 30 refers to key state information 113 held by smart contract S2B, and determines that key state information 113 of storage unit 31B is updated to indicate that storage unit 31B is unlocked.

In step S344, storage unit 31B is unlocked. This is carried out based on the fact that lock controller 33 has determined, in step S343, that key state information 113 of storage unit 31B is updated to indicate that storage unit 31B is unlocked.

In step S345, item 5 is stored in storage unit 31B by user U1.

In step S306, user U1 controls, via terminal 21, locking of storage unit 31B. In the locking control, terminal 21 transmits a lock request to lock storage unit 31B to smart contract S2B.

In step S333, smart contract S2B updates lock history 15 by adding information indicating that the lock request has been received, and changes key state information 113 to indicate that storage unit 31B is locked.

In step S346, lock controller 33 in storage unit system 30 refers to key state information 113 held by smart contract S2B, and determines that key state information 113 of storage unit 31B is updated to indicate that storage unit 31B is locked.

In step S347, storage unit 31B is locked. This is carried out based on the fact that lock controller 33 has determined that key state information 113 of storage unit 31B is updated to indicate that storage unit 31B is locked.

In step S322, smart contract S1 transmits, to smart contract S2B, holder change request information indicating that the keyholder of storage unit 31B is to be changed from user U1 to user U2. Receiving the holder change request information, smart contract S2B changes the keyholder of storage unit 31B from user U1 to user U2 based on the received holder change request information.

Moving on to FIG. 12, user U2 controls unlocking of storage unit 31B via terminal 21 in step S311. In the unlocking control, terminal 22 transmits an unlock request to unlock storage unit 31B to smart contract S2B.

In step S334, smart contract S2B updates lock history 15 by adding information indicating that the unlock request has been received, and changes key state information 113 to indicate that storage unit 31B is unlocked.

In step S348, lock controller 33 in storage unit system 30 refers to key state information 113 held by smart contract S2B, and determines that key state information 113 of storage unit 31B is updated to indicate that storage unit 31B is unlocked.

In step S349, storage unit 31B is unlocked. This is carried out based on the fact that lock controller 33 has determined that key state information 113 of storage unit 31B is updated to indicate that storage unit 31B is unlocked.

In step S350, item 5 is taken out from storage unit 31B by user U2.

In step S323, smart contract S1 performs processing of ending the use of storage unit 31B. In the ending processing, smart contract S1 transmits, to smart contract S2B, holder change request information indicating that the keyholder of storage unit 31B is to be changed from user U2 to the manager. Receiving the holder change request information, smart contract S2B changes the keyholder of storage unit 31B from user U2 to the manager based on the received holder change request information.

With the processing illustrated in FIG. 11 and FIG. 12, user U1 can deliver item 5 to user U2 via storage unit 31B.

Note that by removing storage unit 31 and subsequently adding new storage unit 31, it is possible to change storage units 31. When the functions of storage unit 31 to be removed is different from the functions of storage unit 31 to be added, it is possible to add or delete a function according to the removal and addition of storage units 31.

For example, the state in which storage unit system 30 includes storage units 31A, 31B, and 31C ((b) in FIG. 8) can be changed to the state in which storage unit 31C is changed to storage unit 31D ((c) in FIG. 8). Here, storage unit 31D is a storage unit different from storage unit 31C and has, for example, a function different from that of storage unit 31C. When storage unit 31D has a function different from that of storage unit 31C, smart contract S1 operates, in server 10, smart contract S2D corresponding to storage unit 31D.

In this way, when the configuration of management system 1 is to be changed, it is possible to sustainably operate management system 1 as a whole without stopping the entire system.

Variation 1 of Embodiment

A management system according to this variation includes plural storage unit systems 30 according to the above-described embodiment which are usable with high convenience.

Figure 13:
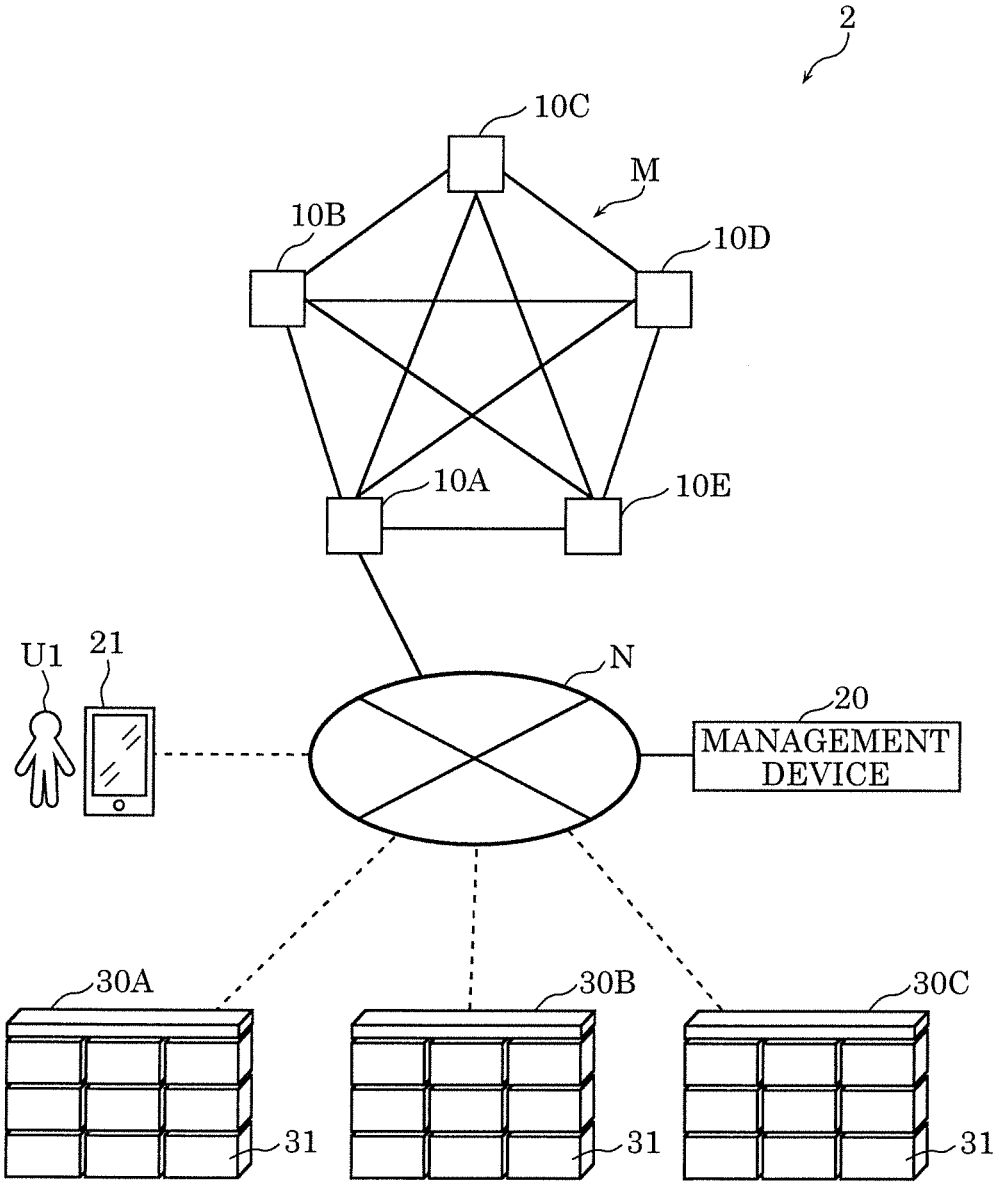
FIG. 13 is a block diagram schematically illustrating a configuration of a management system according to Variation 1 of the embodiment.

FIG. 13 is a block diagram schematically illustrating a configuration of management system 2 according to this variation.

Management system 2 illustrated in FIG. 13 includes storage unit systems 30A, 30B, and 30C.

When plural storage unit systems 30 are provided, it is assumed that the user cannot know which storage unit system 30 includes storage units that are available. When plural storage unit systems 30 available to the user are provided in various institutions and local areas, for example, the user desires to use any available storage unit 31 belonging to any storage unit system 30. With management system 2 according to this variation, it is possible to identify storage unit system 30 that includes storage unit 31 available to the user, and allows the user to use that storage unit 31.

Figure 14:
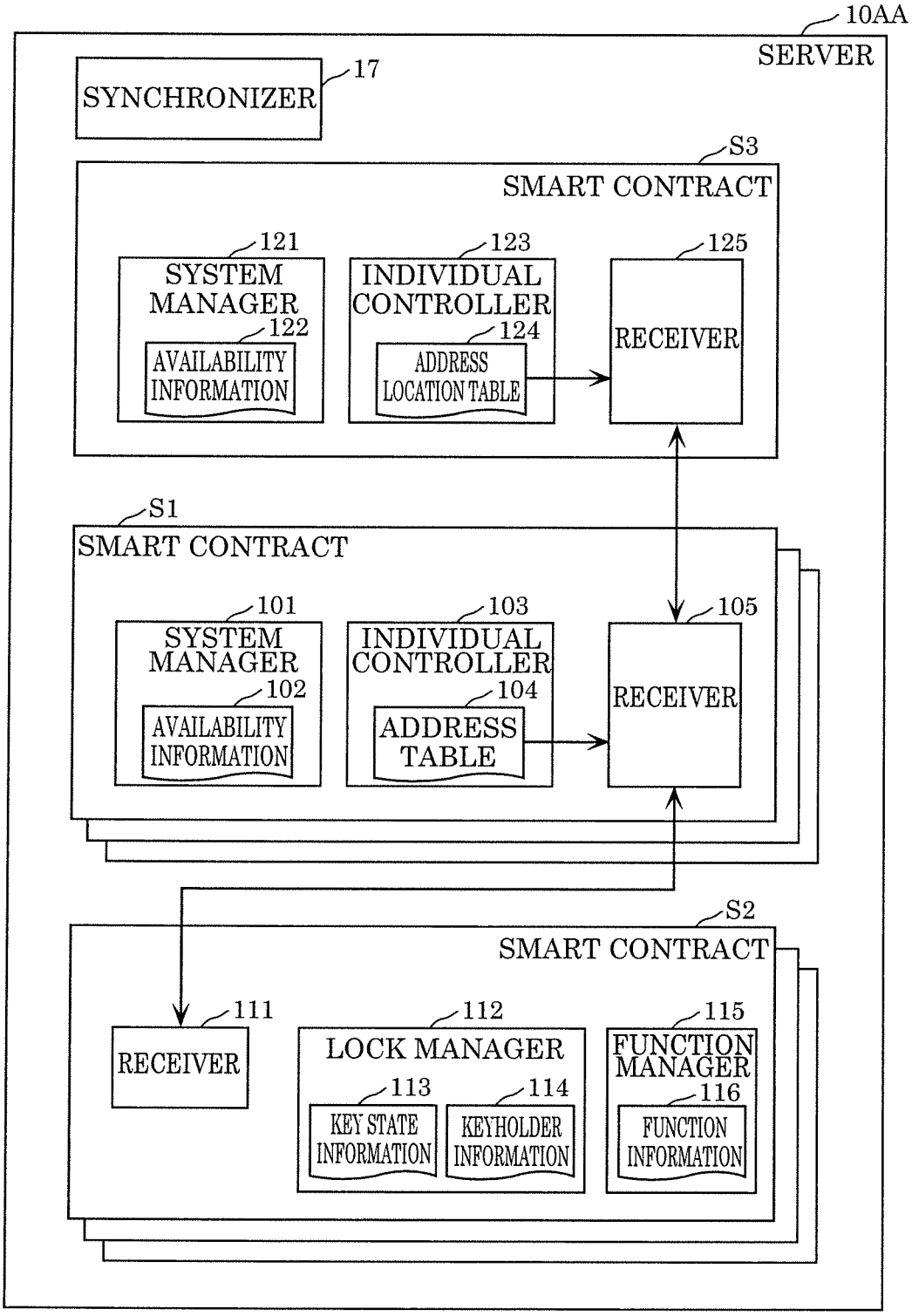
FIG. 14 is a block diagram illustrating a functional configuration of a server according to Variation 1 of the embodiment.

FIG. 14 is a block diagram illustrating a functional configuration of server 10AA according to this variation. Server 10AA operates as each of server 10A and other servers illustrated in FIG. 13. The following describes server 10AA mainly focusing on a difference between server 10AA and server 10A, etc. according to the above-described embodiment.

As illustrated in FIG. 14, server 10AA includes synchronizer 17, smart contracts S1, smart contracts S2, and smart contract S3.

Management system 2 includes one smart contract S3, one or more smart contracts S1, and one or more smart contracts S2.

Smart contract S3 may manage one or more smart contracts S1. Each of one or more smart contracts S1 may manage one or more smart contracts S2, as is the case of smart contract S1 according to the above-described embodiment. Stated differently, server 10AA controls storage unit system 30 by smart contract S3, smart contracts S1, and smart contracts S2, which are configured to have a hierarchical structure of three layers.

Smart contract S3 manages the locations at which storage unit systems 30 are provided. Smart contract S3 is a function that is achieved by server 10AA executing contract code C3 (not indicated) stored in a ledger in ledger storage 14.

Smart contract S3 includes system manager 121, individual controller 123, and receiver 125. It is assumed that smart contract S3 manages plural storage unit systems 30 and continues to operate even when storage unit 31 is to be added or removed to or from storage unit system 30. Smart contract S3 corresponds to the third smart contract.

System manager 121 manages attribute information such as identification information and locations of storage unit systems 30A, 30B, and 30C, and availability information 122 indicating whether each of storage units 31 included in each of storage unit system 30A and other storage unit systems is being used. When receiving, from terminal 21 or the like, an inquiry on the attribute information and availability information 122 of each of storage unit system 30A and other storage unit systems, system manager 121 generates response information based on the attribute information and availability information that are under its management, and transmits the generated response information to terminal 21 or the like. System manager 121 also receives a use request to use storage unit 31 from terminal 21 or the like, and updates availability information 122.

Specifically, when receiving, from terminal 21, an inquiry on whether storage unit 31 is being used, system manager 121 generates response information in response to the inquiry and transmits the generated response information to terminal 21. Here, when receiving a use request to use storage unit 31, system manager 121 declines the request if storage unit 31 of which the use has been requested is being used, but accepts the request if that storage unit 31 is not being used. Note that when storage unit 31 of which the use has been requested is not being used, system manager 121 may accept the request only when processing of charging a fee for this new use is completed.

Individual controller 123 is a processing unit that controls whether to place each of storage unit system 30A and other storage unit systems under its management. Individual controller 123 has address location table 124 on memory 12. Address location table 124 stores the storage addresses of smart contracts S1 operated by storage unit system 30A, etc. that is placed under the management of individual controller 123.

Specifically, when receiving, from management device 20, a deletion request to delete storage unit system 30A or the like, individual controller 123 excludes, from the management, smart contracts S1 operated by storage unit system 30A to be removed. In order to exclude smart contracts S1 from the management, individual controller 123 deletes, from address location table 124, the addresses of smart contracts S1 to be excluded. When receiving, from smart contract S1, an addition request to add new storage unit system 30A or the like, individual controller 123 additionally places, under the management, smart contracts S1 to be operated by new storage unit system 30A. In order to place smart contracts S1 under the management, individual controller 123 causes memory 12 to additionally store the addresses of smart contracts S1 in address location table 124.

Receiver 125 is a processing unit that receives an inquiry on each of the functions of storage unit 31. When receiving an inquiry on each of the functions of storage unit 31, receiver 125 reads, from address location table 124, the address of smart contract S1 operated by storage unit system 30A to which storage unit 31 for which the inquiry has been received belongs, and transfers the received inquiry to that address. The response information is transmitted to terminal 21 or the like in response to the inquiry as a result of the transfer.

Synchronizer 17 and smart contracts S1 and smart contracts S2 are the same as those described in the above-described embodiment.

FIG. 15 is an illustration of availability information 122 used in management system 2 according to this variation.

Availability information 122 includes information such as storage ID 61, used/unused 62, and system ID 63.

Storage ID 61 is an identifier that may uniquely identify storage unit 31.

Used/unused 62 is information indicating whether storage unit 31 is being used.

Storage ID 63 is an identifier of storage unit system 30A, etc. to which storage units 31 belong.

When receiving, from terminal 21 of user U1, inquiry information for making an inquiry on available storage units 31, system manager 121 refers to availability information 122, generates response information indicating the identifier of storage unit system 30A, etc. to which available storage unit 31 belongs, and transmits the generated response information to terminal 21.

Having received the response information, terminal 21 selects a storage unit system to which available storage unit 31 belongs, from among storage unit system 30A and other storage unit systems, and thus can use the selected storage unit system. The method for using a management system to which available storage unit 31 belongs is the same as that described in the above-described embodiment.

With management system 2 having such a configuration, it is possible to identify storage unit system 30 to which storage unit 31 available to the user belongs, and thus, the user can use that storage unit 31.

Variation 2 of Embodiment

This variation describes a different embodiment of the control method and information processing device according to the above-described embodiment and variation.

Figure 16:
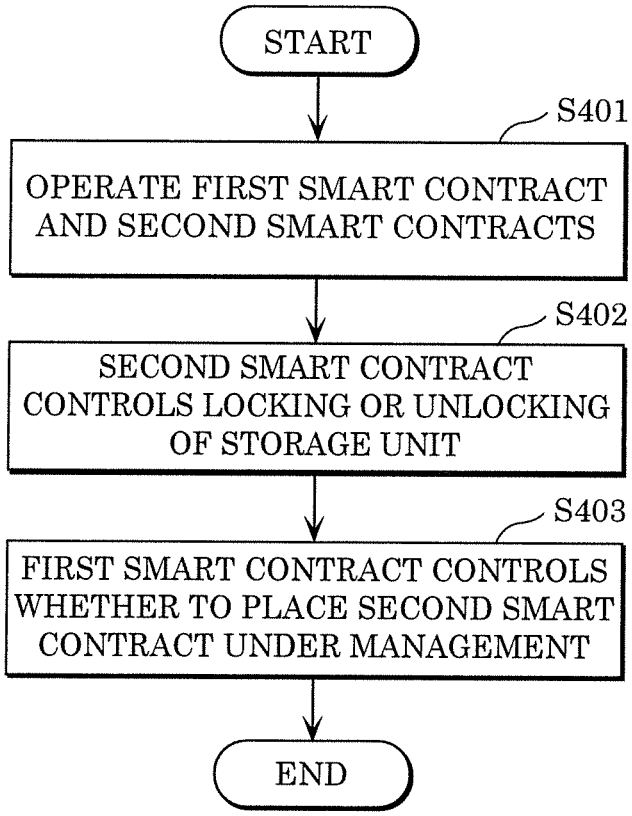
FIG. 16 is a flowchart illustrating a control method according to Variation 2 of the embodiment.

FIG. 16 is a flowchart illustrating a control method according to this variation.

As illustrated in FIG. 16, the control method according to this variation is a control method of controlling, using a distributed ledger, locking or unlocking of one or more storage units, in each of which an item is storable.

In step S401, a first smart contract and one or more second smart contracts are operated by a code, stored in a distributed ledger, being executed by a computer. The first smart contract manages one or more second smart contracts that are in one-to-one correspondence with one or more storage units.

In step S402, each of one or more second smart contracts controls, under the management by the first smart contract, locking or unlocking of a storage unit, among one or more storage units, which corresponds to the second smart contract.

In step S403, the first smart contract controls whether to place each of the second smart contracts under the management.

With this, it is possible to operate the storage unit system without stopping the entire storage unit system, even when the configuration of the storage unit system is changed.

Figure 17:
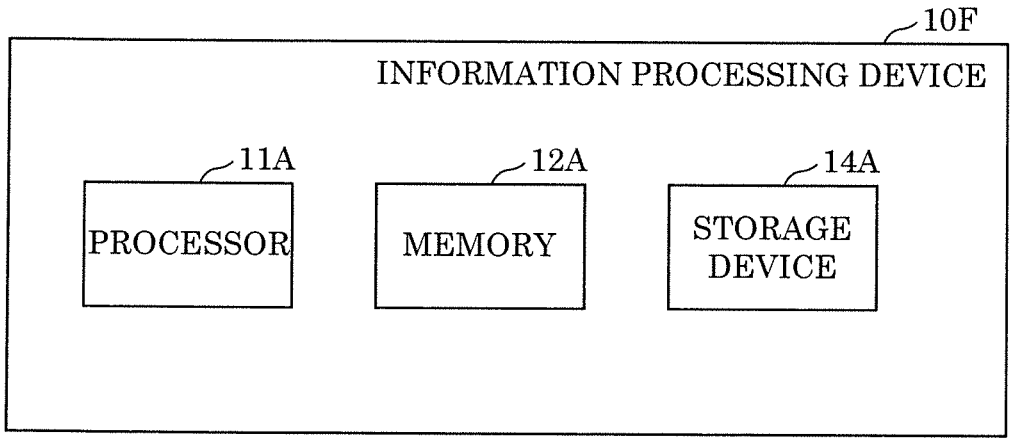
FIG. 17 is a block diagram illustrating a configuration of an information processing device according to Variation 2 of the embodiment.

FIG. 17 is a block diagram illustrating a configuration of an information processing device according to this variation.

As illustrated in FIG. 17, information processing device 10F according to this variation is one of a plurality of information processing devices that controls, using a distributed ledger, locking or unlocking of one or more storage units, in each of which item 5 is storable.

Information processing device 10F includes processor 11A, memory 12A, and storage device 14A that stores a distributed ledger in which codes are stored.

Processor 11A operates first smart contract and one or more second smart contracts by executing a code stored in the distributed ledger. The first smart contract manages one or more second smart contracts that are in one-to-one correspondence with one or more storage units.

Subsequently, each of one or more second smart contracts controls, under the management by the first smart contract, the locking or unlocking of a storage unit, among one or more storage units, which corresponds to the second smart contract.

The first smart contract controls whether to place each of one or more second smart contracts under the management.

With this, it is possible to operate the storage unit system without stopping the entire storage unit system, even when the configuration of the storage unit system is changed.

As has been described above, with the control method according to this embodiment, the storage unit system is controlled by the first smart contracts and the second smart contracts. When a change such as adding or removing a storage unit to or from the storage unit system or a change in the functions of a storage unit occurs, only the operation of the second smart contract related to the change needs to be stopped. Stated differently, it is possible to maintain the operations of the first smart contract and the second smart contracts that are unrelated to the change. Supposing that the storage unit system is controlled by a single smart contract, the operation of the smart contract needs to be stopped when a storage unit is to be added to the storage unit system and this causes problems in the operation of the storage unit system. With the control method according to one aspect of the present disclosure, it is possible to operate the storage unit system without stopping the entire storage unit system, even when the configuration of the storage unit system is changed.

When a storage unit is to be removed from the storage unit system, the first smart contract excludes, from the management, the second smart contract corresponding to the storage unit to be removed. Therefore, when a storage unit is to be removed, it is possible to maintain the operations of the first smart contract and the second smart contracts that are not to be removed. With this, it is possible to operate the storage unit system without stopping the entire storage unit system, even when the configuration of the storage unit system is changed.

When a storage unit is to be added to the storage unit system, the first smart contract additionally places, under the management, the second smart contract corresponding to the storage unit to be added. Therefore, when a storage unit is to be added to the storage unit system, it is possible to maintain the operations of the first smart contract and the second smart contracts that are already in operation. With this, it is possible to operate the storage unit system without stopping the entire storage unit system, even when the configuration of the storage unit system is changed.

The first smart contract provides response information in response to an inquiry on the availability of storage units. Accordingly, it is possible to respond to such an inquiry even when the configuration of the storage unit system is changed.

It is also possible to manage storage units so that the use of a storage unit is allowed when that storage unit is not being used. With this, it is possible to prevent the inconvenience such that plural users use the same storage unit.

It is also possible to manage the storage units so that a storage unit can be used only when processing of charging a fee, for example, for the use of that storage unit is completed.

When an inquiry is made on the function(s) of a storage unit, a smart contract corresponding to the storage unit for which the inquiry has been made is caused to respond to the inquiry. By managing information that is different from storage unit to storage unit, using a second smart contract corresponding to a storage unit, a function of the first smart contract needs to be added as least as possible. With this, it is possible to operate the storage unit system without stopping the entire storage unit system, even when the configuration of the storage unit system is changed.

Whether to place a second smart contract under management is controlled based on whether a computer is storing, in a memory, the address of the second smart contract. With this, it is possible to operate the storage unit system without stopping the entire storage unit system, even when the configuration of the storage unit system is changed.

The storage unit system is controlled by the first smart contracts, the second smart contracts, and the third smart contract. When a change such as adding or removing a storage unit to or from the storage unit system or a change in the functions of a storage unit occurs, only the operation of the second smart contract related to the change needs to be stopped. Stated differently, it is possible to maintain the operations of the first smart contracts, the third smart contract, and the second smart contracts that are unrelated to the change. Furthermore, since the third smart contract controls whether to place each of the first smart contracts under its management, it is easier to control a plurality of first smart contracts.

Note that each of the structural elements in the above embodiments may be configured in the form of an exclusive hardware product, or may be implemented by executing a software program suitable for each structural element. Each of the structural elements may be implemented by means of a program executing unit, such as a CPU or a processor, reading and executing the software program recorded on a recording medium such as a hard disk or a semiconductor memory. The software that implements the information processing device etc. according to the above embodiment is a program as follows.

That is to say, this program causes a computer to execute the control method of controlling, using a distributed ledger, locking or unlocking of one or more storage units, in each of which an item is storable. The control method includes: operating a first smart contract and one or more second smart contracts, by a code, stored in the distributed ledger, being executed by a computer, the first smart contract managing the one or more second smart contracts that are in one-to-one correspondence with the one or more storage units; controlling, by each of the one or more second smart contracts, locking or unlocking of a corresponding one of the one or more storage units, the controlling being performed under the management by the first smart contract; and controlling, by the first smart contract, whether to place each of the one or more second smart contracts under the management.

While the foregoing has described the control method and the related technologies according to one or more aspects of the present disclosure based on exemplary embodiments, the present disclosure is not limited to these embodiments. Various modifications to these embodiments conceivable to those skilled in the art, as well as embodiments resulting from combinations of structural elements in different embodiments may be included within the scope of one or more aspects of the present disclosure, so long as they do not depart from the essence of the present disclosure.

Although only some exemplary embodiments of the present disclosure have been described in detail above, those skilled in the art will readily appreciate that many modifications are possible in the exemplary embodiments without materially departing from the novel teachings and advantages of the present disclosure. Accordingly, all such modifications are intended to be included within the scope of the present disclosure.

INDUSTRIAL APPLICABILITY

The present disclosure is applicable to a control method with which it is possible to operate a storage unit system without stopping the entire storage unit system, even when the configuration of the storage unit system is changed. Specifically, the present disclosure is applicable, for example, to a locker provided for public use.

What is claimed is:

1. A control method of controlling, using a distributed ledger, one or more storage units, in each of which an item is storable, the control method comprising:

operating a first smart contract and one or more second smart contracts, by a code, stored in the distributed ledger, being executed by a computer, the first smart contract managing the one or more second smart contracts that are in one-to-one correspondence with the one or more storage units;

controlling, by each of the one or more second smart contracts, a corresponding one of the one or more storage units, the controlling being performed under the management by the first smart contract; and controlling, by the first smart contract, whether to place each of the one or more second smart contracts under the management.

2. An information processing device that controls, using a distributed ledger, one or more storage units, in each of which an item is storable, the information processing device being one of a plurality of information processing devices, the information processing device comprising:

a processor;

a memory; and a storage device in which the distributed ledger is stored, the distributed ledger storing a code, wherein the processor operates a first smart contract and one or more second smart contracts by the code, stored in the distributed ledger, being executed using the memory, the first smart contract managing the one or more second smart contracts that are in one-to-one correspondence with the one or more storage units, each of the one or more second smart contracts controls, under the management by the first smart contract, a corresponding one of the one or more storage units, and the first smart contract controls whether to place each of the one or more second smart contracts under the management.

3. A management system, comprising:

a plurality of information processing devices each being the information processing device according to claim 2; and the one or more storage units are controlled using the distributed ledger by the plurality of information processing devices.

4. A non-transitory computer-readable recording medium for use in a computer, the recording medium having a computer program recorded thereon for causing the computer to execute the control method according to claim 1.

* * * * *